US006031163A

United States Patent [19]

Cullum et al.

[11] Patent Number: 6,031,163

[45] Date of Patent: Feb. 29, 2000

[54] ADJUSTABLE SHOULDER REST FOR VIOLINS OR THE LIKE

[75] Inventors: Darcy Cullum; Wilhelmus Van Den Akker, both of Ontario, Canada

[73] Assignee: The Kun Shoulder Rest, Inc., Ottawa, Canada

[21] Appl. No.: 09/253,141

[22] Filed: Feb. 19, 1999

[30] Foreign Application Priority Data

Mar. 11, 1998 [CA] Canada ..... 2231856

[51] Int. Cl.[7] ..... G10D 1/02

[52] U.S. Cl. ..... 84/279; 84/278

[58] Field of Search ..... 84/279, 278, 280

[56] References Cited

U.S. PATENT DOCUMENTS

| | | | |
|---|---|---|---|
| 3,631,754 | 1/1972 | Kun | 84/280 |
| 4,333,378 | 6/1982 | Hrdlička | 84/280 |
| 4,386,548 | 6/1983 | Wolf | 84/280 |
| 5,270,474 | 12/1993 | Kun | 84/280 |
| 5,275,078 | 1/1994 | Wolf | 84/280 |
| 5,419,226 | 5/1995 | Kun | 84/280 |
| 5,567,893 | 10/1996 | Kun | 84/280 |
| 5,780,756 | 7/1998 | Babb | 84/280 |

FOREIGN PATENT DOCUMENTS 198008 3/1920 Canada .

*Primary Examiner*—Robert E. Nappi
*Assistant Examiner*—Shih-yung Hbach
*Attorney, Agent, or Firm*—Stevens, Davis, Miller & Mosher, L.L.P.

[57] ABSTRACT

The adjustment of the distance between clamping elements (13, 14) of a shoulder rest for violin or the like instrument is effected by a stem-like fastener, preferably a thumbscrew (37) passing through one of generally equidistantly spaced apart openings (29, 30) in a foot member (17) and through that opening (29, 30) which is aligned with one of at least two nuts (33, 34) embedded in an elongated base (10) of the shoulder rest.

According to the invention, the longitudinal spacing between the openings (29, 30) differs from that of the nuts (33, 34) preferably such that one spacing is one-half of the other, whereby a fine adjustment of the clamping distance can be achieved, while the number of the nuts (33, 34) and/or the openings (29, 30) is relatively small, in the embodiment shown, two of each, permitting a total of four different adjustments of the clamping distance.

7 Claims, 4 Drawing Sheets

ADJUSTABLE SHOULDER REST FOR VIOLINS OR THE LIKE

BACKGROUND OF THE INVENTION

The present invention relates to a shoulder rest for use with a violin or a violin-like instrument. More specifically, the invention relates to the type of shoulder rests having a relatively rigid, elongated base and upright clamping elements secured one to each end of the base. The distance between the clamping elements is adjustable to match several sizes of the body of the instrument. The adjustment of the distance between the clamping elements of the shoulder rest is effected by utilizing a row of openings provided in a foot member of at least one clamping element. The row of openings extends along the base. The openings are equidistantly spaced from each other. One or two openings are engaged with a stem-like projection or projections protruding from the top surface of the base. Thus a positive locking of the foot member is achieved, in a number of locations along the base member. In known adjustment mechanisms of this type, the number of positively locked positions is equal to or smaller than the number of the openings in the foot member. The adjacent locked positions are spaced from each other a distance equal to the spacing between adjacent openings.

The above type of adjustability of the shoulder rests has become popular because of simplicity of the structure and adjustment, its security once adjusted, and a number of sizes of violins which can be accommodated by a single shoulder rest.

A typical example of adjustable shoulder rests of this type is described, for instance, in U.S. Pat. No. 5,419,226 (Kun) issued May 30, 1995. A number of openings is provided in a foot member of each of the clamping elements at each end of the base of the shoulder rest. Another, somewhat more complex and expensive, embodiment of this principle is shown in U.S. Pat. No. 3,631,754 (Kun), issued Jan. 4, 1972.

While the adjustability of the above prior art may often be sufficient, there are applications where the spacing between adjacent openings in the foot portion is optimal for manufacture but may be too large to accommodate relatively large differences in the size of violins. This is particularly notable in the area of shoulder rests for small, children's size violins ranging from size 1/16, to 1/4. In such applications, the spacing between adjacent adjustment positions presents too large a percentage of the overall desired clamping distance due to a small size of the violins with the result that, in one position, the clamping force may be too small and in the next position excessive. Also, the length of the foot portion required to provide four adjustment positions is too much for small size violins, where space saving is of the essence.

It is also known to provide a non-positively locked adjustment of the distance between the clamping elements of a violin shoulder rest by a slide-and-setscrew arrangement such as described in U.S. Pat. No. 5,275,078 (Wolf) issued Jan. 4, 1994, where a sleeve with a setscrew receives a sliding arm supporting one of the clamping elements. On adjustment of the distance, the setscrew is tightened to secure the clamping distance. Another arrangement of a non-locked adjustment is described in U.S. Pat. No. 4,333,378 (Hrdlička), issued Jun. 8, 1982 utilizing a longitudinal slot in the foot member and two threaded stems, projecting from the base and through the slot. Thumbnuts threaded on the stems secure the foot member (and thus the associated clamping element) to the base.

The disadvantage of the non-positively locked arrangement is that it does not provide means which would indicate inadvertent loosening of the setscrew, thumbnuts or other similar fasteners. This may result in diminished tightness of the clamping force with the possibility of accidental release of the shoulder rest from a violin while playing the instrument. The structural complexity is another disadvantage of this type of adjustment mechanism.

It is an object of the present invention to provide an improvement of the first mentioned, positively locked stem-and-opening type of adjustment which would utilize a convenient spacing between the openings in the foot portion of a support of a clamping element while at the same time allowing adjustability in a number of positions which is larger than the number of the openings in the foot portion.

SUMMARY OF THE INVENTION

In general terms, the invention provides a shoulder rest for use with a violin or violin like instrument which comprises an elongated base having an upper surface and a lower surface which rests, in use, on the shoulder of a player of the instrument. A first clamping element and a second clamping element are provided, one at each and of the base. The clamping elements and the base, while being both generally rigid, provide sufficient flexibility to resiliently but firmly clamp side wall portions of a body of a violin or the like, to thus secure the base to said instrument.

The first clamping element is provided with adjustment means securing it to said base in a positively locked engagement at a selectively adjustable distance from the second clamping element. The adjustment means includes a foot portion of a support of the clamping member compatible with the upper surface of the base. The foot portion comprises at least two generally upright first passages spaced from each other longitudinally of said base, at a first spacing.

The reference to "positive locking" in the context of this application designates an arrangement whereby the foot member, once secured in a predetermined position, is presented from longitudinal shifting relative to the base not only by a frictional force generated by the thumbnut or the like and pressing the foot to the base, but also by a positive abutment between the stem-like fastener and the respective opening.

Two generally upright second passages, preferably two nuts, are provided at the first end of the base. They are spaced from each other longitudinally of the base at a second spacing. The adjustment means further comprises stem-like fastener means, preferably a thumbscrew, compatible with said first and second passages. The fastener is adapted to pass through one of the first and second passages and to be secured, preferably by a threaded engagement, to the other of the aligned first and second passages to thus fixedly secure the foot portion to said upper surface both frictionally and in a positively locked fashion.

One of said first and second spacings is a fraction, preferably one-half, of the other spacing. As a result, only one of said first passages can be aligned at a time with one a second passage for receiving said fastener means.

The fraction, i.e. the smaller spacing, between the adjacent openings, is preferably the spacing between passages in the foot portion.

The invention will be described by way of a preferred embodiment, with reference to the accompanying drawings. This embodiment is designed for small violins of the size 1/4 to 1/16. It will be understood that many modifications of this embodiment may be made without departing from the scope of the invention.

DETAILED DESCRIPTION OF THE PREFERRED EMBODIMENTS

Figure 1:
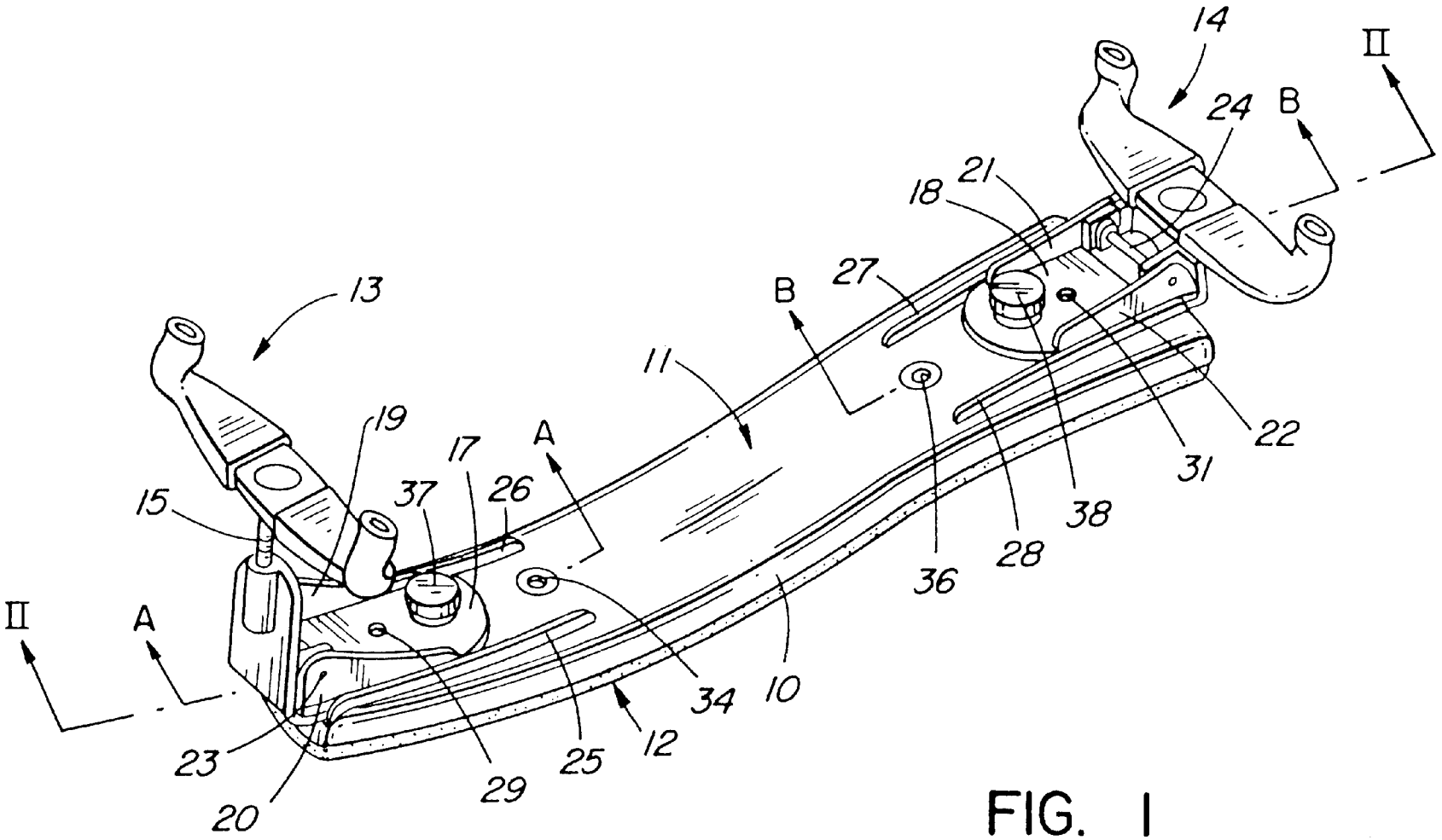
FIG. 1 is a top, front and end perspective view of the preferred embodiment.

The shoulder rest has a longitudinal base 10 moulded from a suitable plastic material, for instance glass fibre-filled nylon, which renders the base 10 rigid but having a degree of flexibility. As is well known, the base 10 has an upper surface 11 and a lower surface 12 formed by a plastic foam padding to rest on the shoulder of the violin player.

The shoulder rest further comprises two clamping elements adapted to engage the side wall of the body of a violin. For convenience, the clamping elements are designated as a first clamping element 13 and a second clamping element 14. It is preferred that the clamping elements be of the type of pivotal forks shown in the drawings and well known, for instance from U.S. Pat. No. 3,631,754 (Kun), issued Jan. 4, 1972 which is incorporated herein by reference. The pivoting of the forks is about the axis of generally vertical threaded stems 15, 16. In the embodiment shown, the stems 15, 16 are each received in an upright portion of a generally L-shaped support. The support further includes a generally horizontal flat foot portion 17, 18 which rests on the upper surface 11.

The foot portion 17 is integrally formed with two opposed side flanges 19, 20, and the foot portion 18 is integrally formed with two opposed side flanges 21, 22. The purpose of the flanges 19–22 is to provide a mounting for transverse pivot pins 23, 24 for folding the clamping elements 13, 14 inwardly as described in the above U.S. Pat. No. 5,419,226 (Kun) issued May 30, 1995 which is incorporated herein by reference.

The flanges 19, 20, and thus the foot portion 17, are slidably received between longitudinal ribs 25, 26 and, similarly, the flanges 21, 22 of the foot portion 18 are slidable between a pair of longitudinal ribs 27, 28. The ribs 25–27, integrally formed with and protruding from the upper surface 11 thus provide lateral stability of the foot portions 17–18.

In the embodiment shown, the foot portion 17 is provided with two openings 29, 30. In general terms, they present one embodiment of two generally upright first passages (29, 30) spaced from each other longitudinally of said base, at a first spacing. In the embodiment shown, the spacing between the openings 29, 30 longitudinally of the base 10 is about 8 mm. The opposite foot portion 18 is likewise provided with two openings 31, 32. They are generally referred to as two generally upright first passages (31, 32) spaced from each other longitudinally of said base, at the same first spacing.

Embedded in the base 10 at one end thereof are two nuts 33, 34, which present an embodiment compatible with that having two generally upright first passages 29, 30 referred to above. The two nuts 33, 34 thus present one embodiment of what is generally referred to as two generally upright second passages provided in the base and spaced from each other longitudinally of said base at a second spacing. In the embodiment shown, the spacing between the nuts 33–34 is about 16 mm, i.e. about twice the spacing between the openings 29–30.

The opposite end of the base similarly carries two nuts 35,36 at the spacing which is twice that of the openings 31,32.

Figure 5A:
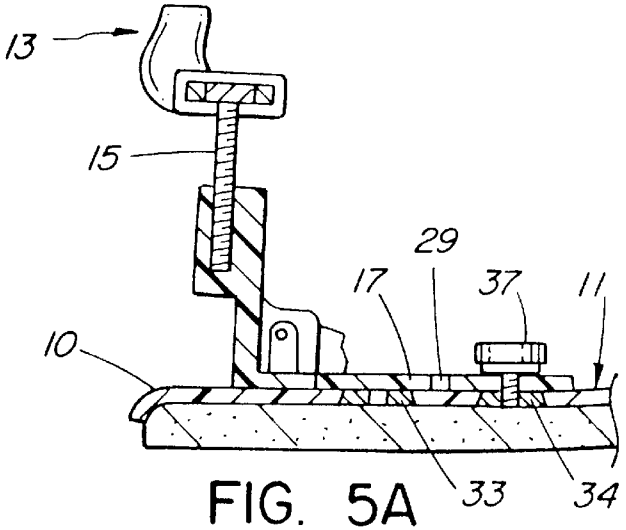
FIGS. 5A and 5B are views similar to those of FIGS. 3A and 3B, but showing the adjustment of the distance one step smaller than that of FIGS. 4A, 4B.
Figure 5B:
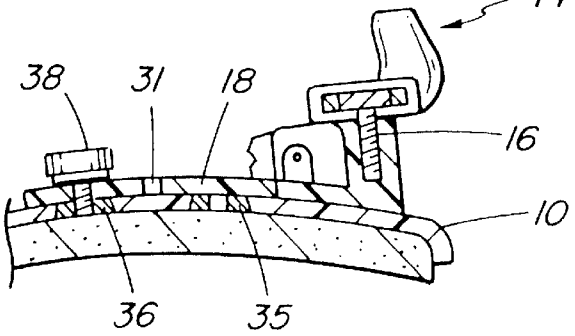

Stem-like fastener means of the type of a thumbscrew 37 compatible with said first and second passages 29, 30 is adapted to pass through one (e.g., opening 30 of the foot portion 17 as shown in FIG. 5A) and becoming secured to the other of a pair of aligned first and second passages (e.g. to the nut 34 in FIG. 5A) to thus press the foot portion 17 to the top surface 11. The opposite foot portion 18 is similarly adjustably secured to the surface 11 using a thumbscrew 38 compatible with the first and second passages 31,32 and with the nuts 35,36.

Figure 2:
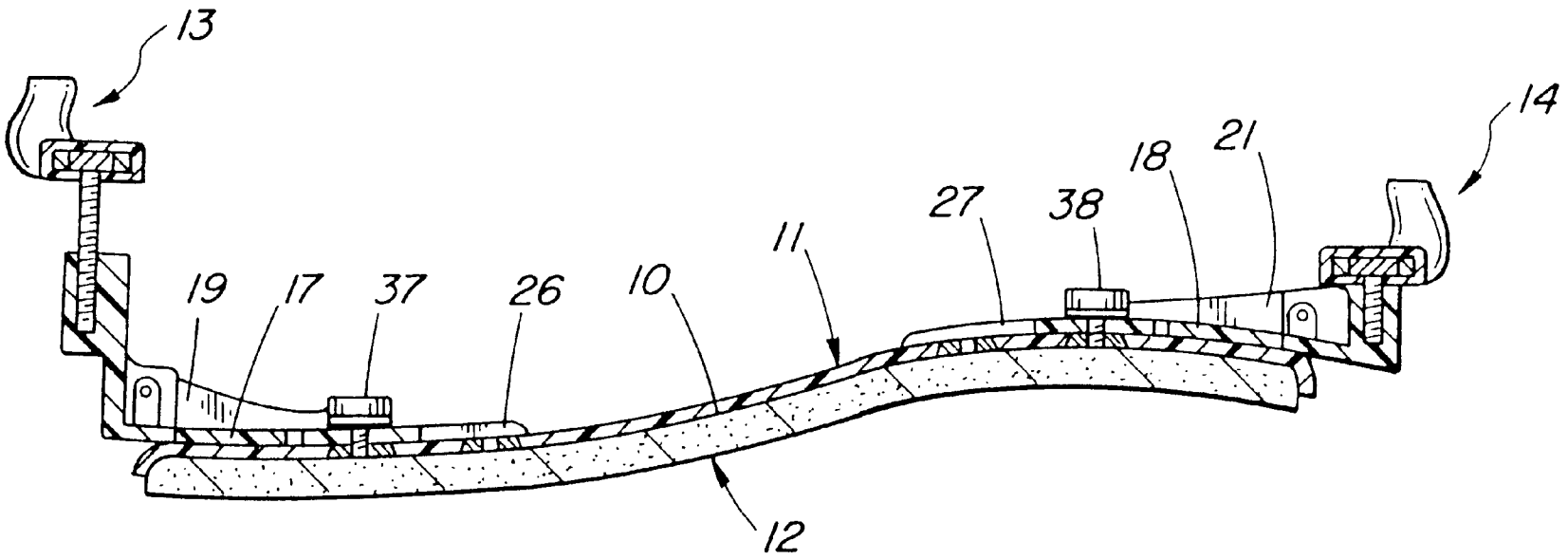
FIG. 2 is a sectional view taken along the line II—II of FIG. 1.

Turning now specifically to the representations of FIGS. 3–6, it will, firstly, be appreciated that while identical clamping distance adjusting arrangements are shown, it is quite possible to use the adjusting means only at one end of the base 10, while the opposite clamping element may be non-adjustably secured to the base 10. Nevertheless, it is preferred, albeit not absolutely required, that both clamping elements 13–14 be adjustable with respect to the distance to the opposed clamping element. Also, the spacing between adjacent openings 29,30 and between the nuts 33,34 at one end of the base 10 is the same as between the openings 31,32 and the nuts 35,36 at the other end. A different mutual spacing may be utilized at the other end compared with the left end (FIG. 2) but it is preferred that the 0.5 to 1.0 ratio be maintained.

Figure 3B:
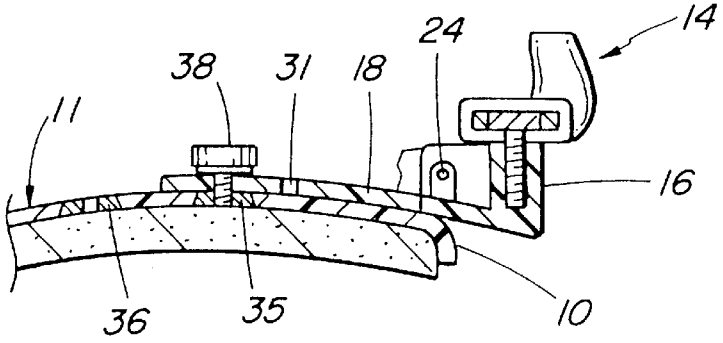
FIGS. 3A and 3B are sectional views taken along section lines A—A and B—B, respectively, of FIG. 1 with certain parts omitted for clarity and showing the adjustment of a maximum distance between the clamping elements.
Figure 3A:
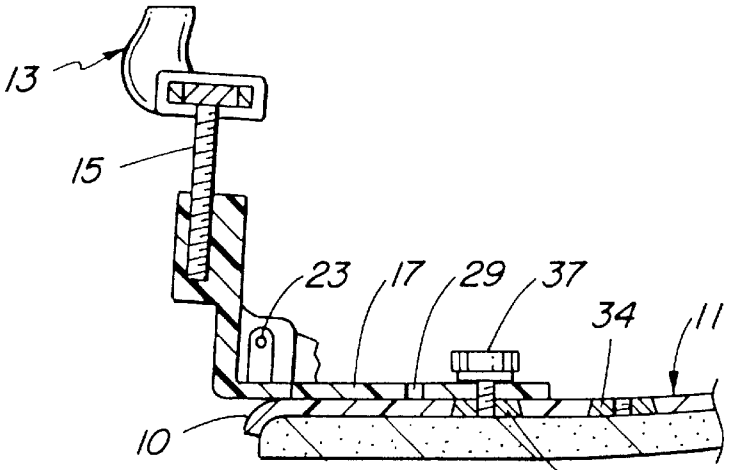

In FIGS. 3A, 3B, the adjustment to a maximum clamping distance is shown. The thumbscrew 37 passes through the inner opening 30 and is threaded in the outer nut 33 and the same mutual arrangement is shown at the support of the opposite clamping element 14 where the thumbscrew 38 passes through the inner opening 32 and into the outer nut 35. It is apparent from the above that the adjective "inner" and "outer" in this context means the location, remote from and relatively close to the respective end of the base 10, respectively.

Figure 4B:
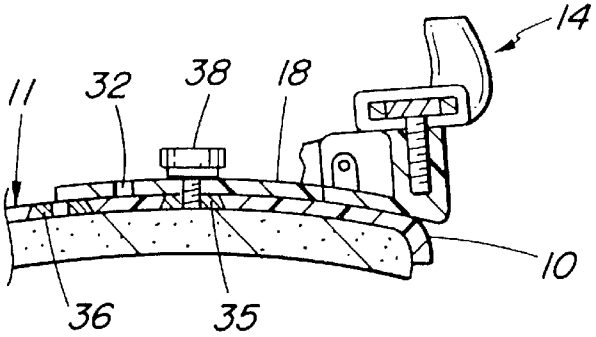
FIGS. 4A and 4B are views similar to those of FIGS. 3A and 3B, but showing the adjustment of the distance one step smaller than that of FIGS. 3A, 3B.
Figure 4A:
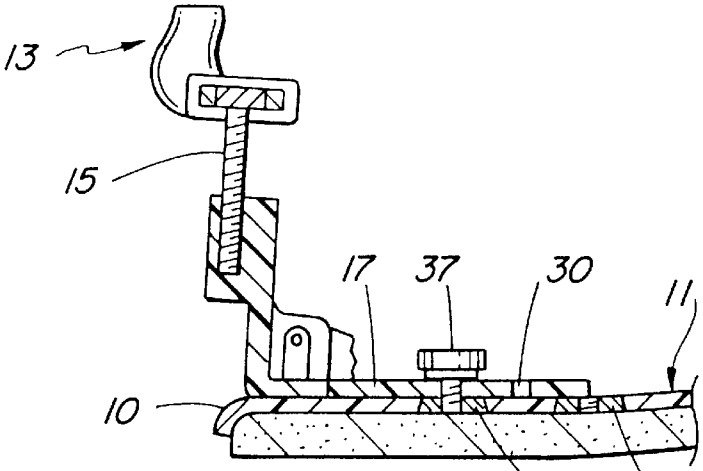

FIG. 4 shows the arrangement of the next smaller distance arrangement, in which at least one (in the embodiment shown, both) clamping element 13 is shifted one step to the right, i.e. toward the opposite clamping element 14 to accommodate a smaller violin body. Here the thumbscrew 37 passes through the outer opening 29 and into the outer nut 33. Note that in this state the inner opening 30 is not aligned with any of the outer and inner nuts 33–34 and is located mid-way between the two. Thus, a relatively small second displacement has been achieved.

In the next step reduction of the clamping distance as shown in FIG. 5, the thumbscrew 37 again passes through the inner opening 30 but this time into the inner nut 34 whereby the inward displacement of the clamping element 13 is only one-half of the distance between the nuts 33–34. This is a further, third relatively small displacement.

Figure 6A:
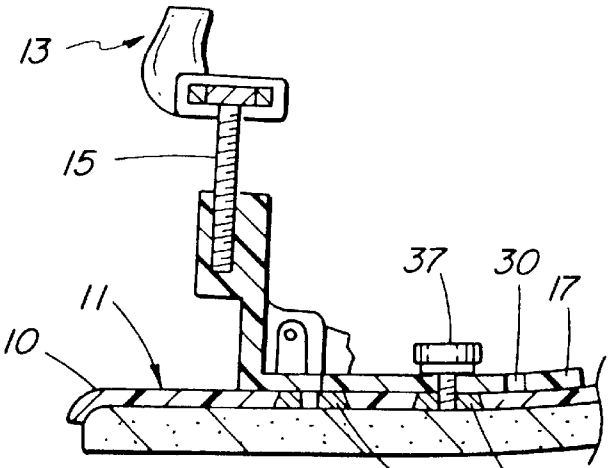
FIGS. 6A and 6B are views similar to those of FIGS. 3A and 3B but showing the adjustment of a minimum distance between the clamping elements.
Figure 6B:
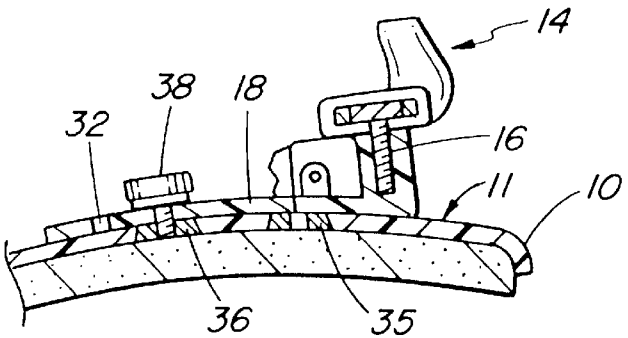

The fourth displacement results in the minimum clamping distance shown in FIG. 6. The thumbscrew 37 passes through the outer opening 29 and into the inner nut 34. Note that the head of the thumbnut 37 is remote from the inwardly shifted free end of the foot portion 17. This is of advantage particularly when providing a shoulder rest for extremely small violins, as the thumbscrew 37 is away from the downwardly cambered bottom of the violin body.

Those skilled in the art will appreciate that further embodiments, differing from the embodiment described may exist. As already mentioned, only one end of the base 10 may be provided with the adjustment means. The spacing between the openings 29–30 vis-a-vis the spacing between the nuts 33, 34 could be reversed allowing for the same fine adjustment. The two nuts 33–34 could be replaced by an integrally moulded strip with two threaded openings. The number of openings 29, 30 is preferably two as it allows a short length of the foot position 17, but this can be changed to any practical number of the openings. The same applies with respect to the number of nuts 33, 34. The spacing system at one end of the base 10 may differ from that at the other end. These and many other embodiments, while departing from the embodiment described, do not depart from the present invention as set forth in the accompanying claims.

We claim:

1. A shoulder rest for use with a violin or a violin-like instrument, comprising:

(a) an elongated base having an upper surface and a lower surface and adapted to rest, in use, on the shoulder of a player of the instrument;

(b) a first clamping element and a second clamping element, said clamping elements being secured to the base one at a first end portion and the clamping element at a second end portion of said base, respectively, projecting upwardly from the base and being adapted to resiliently clamp side wall portions of a body of said instrument therebetween to thus secure the base to said instrument;

(c) said first clamping element being operatively associated with support adjustment means securing a support of the first clamping element to said base in a positively locked engagement at a selectively adjustable distance from the second clamping element, said adjustment means including:

(i) a foot portion of the support of the first clamping element compatible with said upper surface and comprising two generally upright first passages spaced from each other longitudinally of said base, at a first spacing;

(ii) two generally upright second passages provided in said base at said first end portion and spaced from each other longitudinally of said base at a second spacing;

(iii) stem-like fastener compatible with said first and second passages and adapted to pass through one and to be secured to the other of a pair of aligned first and second passages to press the foot portion to said upper surface;

(d) one of said first and second spacings being a fraction of the other, whereby only one of said two first passages can be aligned with one of said second two passages for receiving said fastener.

2. A shoulder rest for use with a violin or a violin-like instrument, comprising:

(a) an elongated base having an upper surface and a lower surface and adapted to rest, in use, on the shoulder of a player of the instrument;

(b) a first clamping element and a second clamping element, said clamping elements being secured to the base one at a first end portion the other clamping element and at a second end portion of said base, respectively, projecting upwardly from the base and being adapted to resiliently clamp side wall portions of a body of said instrument therebetween to thus secure the base to said instrument;

(c) each said clamping element being operatively associated with support adjustment means securing to said base a support of the respective clamping element to said base in a positively locked engagement at a selectively adjustable distance from the other clamping element, said adjustment means including:

(i) a foot portion of the support of the respective clamping element compatible with said upper surface and comprising two generally upright first passages spaced from each other longitudinally of said base, at a first spacing;

(ii) two generally upright second passages provided in said base at the respective end portion and spaced from each other longitudinally of said base at a second spacing;

(iii) stem-like fastener compatible with said first and second passages and adapted to pass through one and to be secured to the other of a pair of aligned first and second passages to press the respective foot portion to said upper surface;

(d) one of the respective first and second spacings being a fraction of the other, whereby only one of the respective two first passages can be aligned with one of the respective two second passages for receiving the respective fastener at each end of said base.

3. The shoulder rest of claim 1, wherein said fraction is equal to about 0.5.

4. The shoulder rest of claim 2, wherein said fraction is equal to about 0.5.

5. The shoulder rest of one of claim 1, wherein the stem-like fastener means is a thumbscrew and the other of the respective pair of aligned first and second passages is a nut compatible with the thumbscrew.

6. The shoulder rest of claim 5, wherein the second passages are nuts embedded in said base and said first passages are openings in the respective foot portion, each opening allowing free passage of the thumbscrew whereby, on tightening the respective thumbscrew, the respective foot portion is fixedly secured to the upper surface of the base.

7. The shoulder rest of one of claim 1, wherein said fraction is the spacing between the passages in the respective foot portion.

* * * * *